US006348145B1

(12) United States Patent
Ropital et al.

(10) Patent No.: US 6,348,145 B1
(45) **Date of Patent: *Feb. 19, 2002**

(54) CHROMIZED REFRACTORY STEEL, A PROCESS FOR ITS PRODUCTION AND ITS USES IN ANTI-COKING APPLICATIONS

(75) Inventors: François Ropital, Rueil Malmaison; Paul Broutin, Chaponost; Marcel François, Ponchon; Alain Bertoli, Cergy Pontoise, all of (FR)

(73) Assignee: Institut Francais du Petrole, Rueil-Malmaison (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/109,867

(22) Filed: Jul. 6, 1998

(30) Foreign Application Priority Data

Jul. 4, 1997 (FR) ..... 97 08511

(51) Int. Cl.[7] ..... C10G 17/00; C25D 5/10

(52) U.S. Cl. ..... 208/48 R; 208/47; 208/50; 148/278; 148/316; 427/228; 427/252

(58) Field of Search ..... 428/610, 667, 428/941; 148/278, 537, 542; 427/228, 252

(56) References Cited

U.S. PATENT DOCUMENTS

| | | | | |
|---|---|---|---|---|
| 4,086,107 A | | 4/1978 | Tanino et al. | 148/136 |
| 4,507,196 A | * | 3/1985 | Reed et al. | 208/48 |
| 4,532,109 A | | 7/1985 | Maeda et al. | 422/240 |
| 4,863,892 A | * | 9/1989 | Porter et al. | 502/170 |
| 5,169,515 A | | 12/1992 | Ngan et al. | 208/48 |
| 5,648,178 A | * | 7/1997 | Heyse et al. | 428/627 |
| 5,658,452 A | | 8/1997 | Heyse et al. | 208/48 |
| 5,873,951 A | | 2/1999 | Wynns et al. | 148/242 |

FOREIGN PATENT DOCUMENTS

| | | |
|---|---|---|
| BE | 810 647 | 5/1974 |
| EP | 0 608 081 | 7/1994 |
| GB | 1149163 | 4/1969 |
| WO | 82/03027 | 9/1982 |
| WO | 95/18849 | 7/1995 |
| WO | 97/16507 | 5/1997 |

OTHER PUBLICATIONS

Patent Abstracts of Japan, vol. 015, No. 289 (C–0852), Jul. 23, 1991 (JP 03 104843).

Patent Abstracts of Japan, vol. 016, No. 190 (C–0937), May 8, 1992 (JP 04 26751).

* cited by examiner

*Primary Examiner*—Deborah Jones
*Assistant Examiner*—Stephen Stein
(74) *Attorney, Agent, or Firm*—Millen, White, Zelano & Branigan, P.C.

(57) ABSTRACT

Coated steel articles are described which exhibit anti-coking properties, and a process for producing such articles by depositing an anti-coking coating on a matrix constituted by a steel, in general a refractory steel. These articles comprise:

a refractory steel substrate comprising at least 0.2% by weight of carbon;

a carbon-rich diffusion barrier; and an outer layer containing 90% to 99% by weight of chromium, coated by a cementation method. More particularly, the coated steel articles constitute tubes for reactors or stills used in various refining or petrochemical processes.

13 Claims, 1 Drawing Sheet

CHROMIZED REFRACTORY STEEL, A PROCESS FOR ITS PRODUCTION AND ITS USES IN ANTI-COKING APPLICATIONS

FIELD OF THE INVENTION

The invention relates to steel articles exhibiting anti-coking properties, and to a process for producing such articles by depositing an anti-coking coating on a matrix constituted by a steel, generally a refractory steel. The process is used to manufacture articles which must be resistant to coking in a variety of refining or petrochemical processes.

The coated articles of the invention can be used in a variety of refining and petrochemical processes which involve temperatures of over 350° C.: steam reforming, dehydrogenation and visbraking, inter alia. More particularly, the invention is applicable to the manufacture of pipe stills for steam cracking intended to have a long service life at temperatures of the order of 800° C. to 1100° C.

BACKGROUND OF THE INVENTION

The carbonaceous deposit which develops in the stills during hydrocarbon conversion is generally known as coke. This coke deposit is a problem in industrial units. The formation of coke on the walls of the pipes and reactors causes a reduction in heat exchange and major blockages and thus pressure drops increase. To keep the reaction temperature constant, it may be necessary to increase the wall temperature, which risks damaging the steel constituting the walls. There is also a reduction in the selectivity of the units and, as a result, a reduction in the yield.

It is thus necessary to stop the units periodically to carry out decoking. It is thus of economic importance to develop materials or coatings which can reduce coke formation.

Many documents have described the coke formation reaction in a variety of reactions which bring hydrocarbons into contact with walls at a high temperature. The coking phenomenon has been widely described and studied for thermal cracking of hydrocarbons in particular. The leading article can be considered to be that by professor FROMENT published in 1990 in the "Review of Chemical Engineering", volume 6, number 4, pages 292 to 328, entitled "Coke formation in the thermal cracking of hydrocarbons". A more recent title which can be cited is that by BILLAUD, BROUTIN, BUSSON, GUERET and WEILL, the first part of which was published in the "Revue de l'Institut Francais du Pétrole", 1992, volume 47, number 4, pages 537 to 549, entitled "Coke Formation during Hydrocarbon Pyrolysis", and the second part of which was published in the same review in 1993, volume 48, number 2, pages 115 to 125.

To summarise the observations described in the prior art, it can be said that coke formation during thermal cracking of hydrocarbons is a complex phenomenon which involves different mechanisms, at least one of which involves reactions catalysed by the presence of oxides of metallic elements such as nickel, iron or cobalt at the walls of the apparatus used to carry out those processes. The metallic elements are generally contained in large quantities in the refractory superalloys used mainly because of the high temperatures encountered at the walls of those apparatus. That catalytic mechanism is highly preponderant: observations have shown that if that mechanism is inhibited, in the case of steam cracking it is possible to increase the length of the cycle between two still decoking stoppages necessary for implementing such a process by a factor of at least 3.

A certain number of documents are based on methods which can inhibit the catalytic formation of coke.

Japanese application P-03-104843 describes a refractory anti-coking steel for a still tube for cracking ethylene.

Further, U.S. Pat. No. 5 208 069 describes a method for passivation of the metal surface of reactor tubes coining into contact with hydrocarbons by in situ decomposition (i.e., in the assembled apparatus) of a non oxygen-containing organometallic silicon derivative under conditions in which a fine layer of ceramic material is formed on the tube surface. That method, in which deposition is carried out at atmospheric pressure or at a slight underpressure, generally does not result in the production of a deposit which is relatively uniform over the entire length of the tubes as the rate of growth of the deposit is not uniform along the entire length of the tube and thus the thickness, and the quality of the deposit, varies along the tube. Such variations entail a risk of producing very thick zones which thus have low adhesion and/or zones in which the silicon carbide deposit is of poor quality and thus of low adhesion. The pressure at which—according to the examples in that patent—vapour phase deposition of an organometallic silicon derivative is carried out is far too high and does not permit homogeneous deposition as gas diffusion distances are much smaller than in a vacuum i.e., at a pressure of less than $10^{+4}$ Pa, for example. Further, the silicon carbide deposited is a compound with a low coefficient of expansion, while the substrate used normally has a far higher coefficient of expansion, which over time with cycles of heating and cooling, entails a non negligible risk of a loss of integrity of the silicon carbide layer at least at some points and as a result, the hydrocarbons come into contact with the superalloys which leads to an increase in the coking rate of the apparatus.

International patent application WO-A-95/18 849 describes articles, used as elements in cracking reactors, coated with a chromium-containing layer which protects against coking. The layer is applied using different plating or by painting. The chromium coatings obtained do not have sufficient resistance to coking, in particular in alternate coking and decoking cycles.

We have now discovered novel anti-coking steels, particularly for use in the applications mentioned above, which do not have the disadvantages mentioned above.

SUMMARY OF THE INVENTION

Thus the invention provides a steel article exhibiting anti-coking properties, characterized in that it comprises:

- a refractory steel substrate comprising at least 0.2% by weight of carbon;
- a carbon-rich diffusion barrier; and
- an outer layer containing 90% to 99% by weight of chromium, characterized in that it is coated using a cementation method.

The substrate (or matrix) is generally constituted by a refractory steel, preferably containing 0.20% to 0.80% (percent) by weight of carbon.

More particularly, the steel has an austenitic grain structure at ambient temperature. A specific steel type for use in the invention is Manaurite® (registered trade mark of MANOIR INDUSTRIES).

Typical examples of steels which can be used in the invention have the main characteristics shown in the following table (the compositions are in weight %):

TABLE 1

| | C | Mn | Si | Ni | Cr | Fe | additions |
|---|---|---|---|---|---|---|---|
| ASTM A297 HK Manaurite 20 ® | 0.30–0.65 | 1–2 | 1–2.5 | 18–24 | 23–28 | compl. | Ti, Nb, W |
| ASTM A297 HL | 0.20–0.60 | 1–2 | 1–2 | 18–22 | 28–32 | compl. | |
| ASTM A297 HN | 0.20–0.50 | 1–2 | 1–2 | 23–27 | 19–23 | compl. | |
| ASTM A297 HP | 0.35–0.75 | 1–2 | 1–2.5 | 33–37 | 24–28 | compl. | |
| Manaurite 36XS ® | 0.35–0.60 | 1–1.5 | 1–2 | 33–38 | 23–28 | compl. | Nb, W |
| Manaurite XM ® | 0.35–0.60 | 1–1.5 | 1–2 | 33–38 | 23–28 | compl. | Nb, Ti, Zr |
| Manaurite XT ® | 0.35–0.45 | 1–1.5 | 1–2 | 42–46 | 32–37 | compl. | Nb |
| Manaurite XTM ® | 0.40–0.45 | 1–2 | 1–2 | 43–48 | 34–37 | compl. | Nb, Ti |

As indicated above, the invention relates more particularly to refractory steel articles coated by thermal chromization methods, such as chromization by cementation, in particular pack cementation or gas phase cementation.

The pack cementation process is well known to the skilled person. It has been described in a number of documents. As an example, the authors of U.S. Pat. No. 5 589 220 state that pack cementation is a process derived from CVD (Chemical Vapour Deposition) which consists of heating a pack at a high temperature in a closed or open vessel containing the metallic article to be coated for a predetermined time during which a diffusion coating is produced on the metallic article. The cementation pack in the closed or open vessel is protected from oxidation by an inert or reducing atmosphere. The cementation pack consists of a metal or alloy article or substrate for coating, surrounded by the elements to be deposited (in the form of a metal or a master alloy), a halide salt activator and a powdered filler. An inert gas such as argon or hydrogen is used as the gaseous environment for the pack. Once the pack has been heated to a fairly high temperature, the salt activator reacts with the metal or master alloy powder to form metal halide vapours. The metal halide vapours diffuse towards the surface of the metal or substrate through the gas phase of the porous pack. At the substrate surface, a reaction step occurs which results in deposition of the desired element and in the formation of a protective coating at the metal surface by solid state diffusion.

The surface reaction can be relatively complex and involves adsorption, dissociation and/or diffusion of molecular species.

Gas phase cementation consists of heating an open vessel containing a metal article to a high temperature for a predetermined period, during which a diffusion coating is produced on the metal article by a chromium halide gas generated by the action of a halide and/or its hydride on a bed of chromium or chromium alloy granules with a 0.1 mm to 50 mm diameter.

The metallising gas is transported from the granule bed to the article by a carrier gas via a specific distributor-diffuser.

The carrier gas is a gas such as argon or hydrogen, as a protective gaseous environment.

The process of supplying metallising gas to the metal article is governed by the rules of fluid dynamics and limits the formation of the chromium deposit.

A balanced choice of physical parameters (temperature, treatment period, mass flow rates of the gaseous species) and the chemical activity of the chromium halide, optimised by the ratio of the solid masses present (halide/granular chromium) in the presence or absence of its hydride, stabilises the chemical activity of the metallising halide and the coating formation conditions.

The concentration by weight of the chromium granules is at least fifty percent.

More particularly in the process of the invention, the pack cementation conditions described below are used.

The articles to be coated are placed in boxes containing a cement constituted by chromium (30% to 40% by weight) and alumina (60% to 70% by weight) powders and a halide activator (0.1% to 2% by weight with respect to the two powders together) in an atmosphere of hydrogen or argon, for example. An isothermal heat treatment is then carried out at a temperature of 900° C. to 1200° C.

The coated articles of the invention can in general be used as constituent materials for tube bundles for hydrocarbon pyrolysis reactors, in the presence or absence of steam, more particularly for steam reforming or steam cracking reactors. They can also be used as constituent materials for tube bundles for oil or petrochemical treatment stills, such as for visbreaking. They can also be used to coat rings and/or baffles in fixed bed reactors for petrochemicals treatments, such as dehydrogenation or reforming.

In this type of application, the coated articles of the invention exhibit improved anti-coking properties. Further, the deposits obtained do not deteriorate during severe thermal cycles between ambient temperature and 1000° C., for example, with heating and cooling rates or 500° C./h.

The entire disclosure of all applications, patents and publications, cited above and below, and of corresponding French application 97/08 511, filed Jul. 4, 1997 are hereby incorporated by reference.

BRIEF DESCRIPTION OF THE DRAWINGS

FIG. 1A is a photograph of a transverse section of the coated article and FIGS. 1D–1C are distribution diagrams for the elements iron, carbon and chromium, respectively, within the substrate and the deposited layer.

Figures 1A, 1B, 1C, 1D:
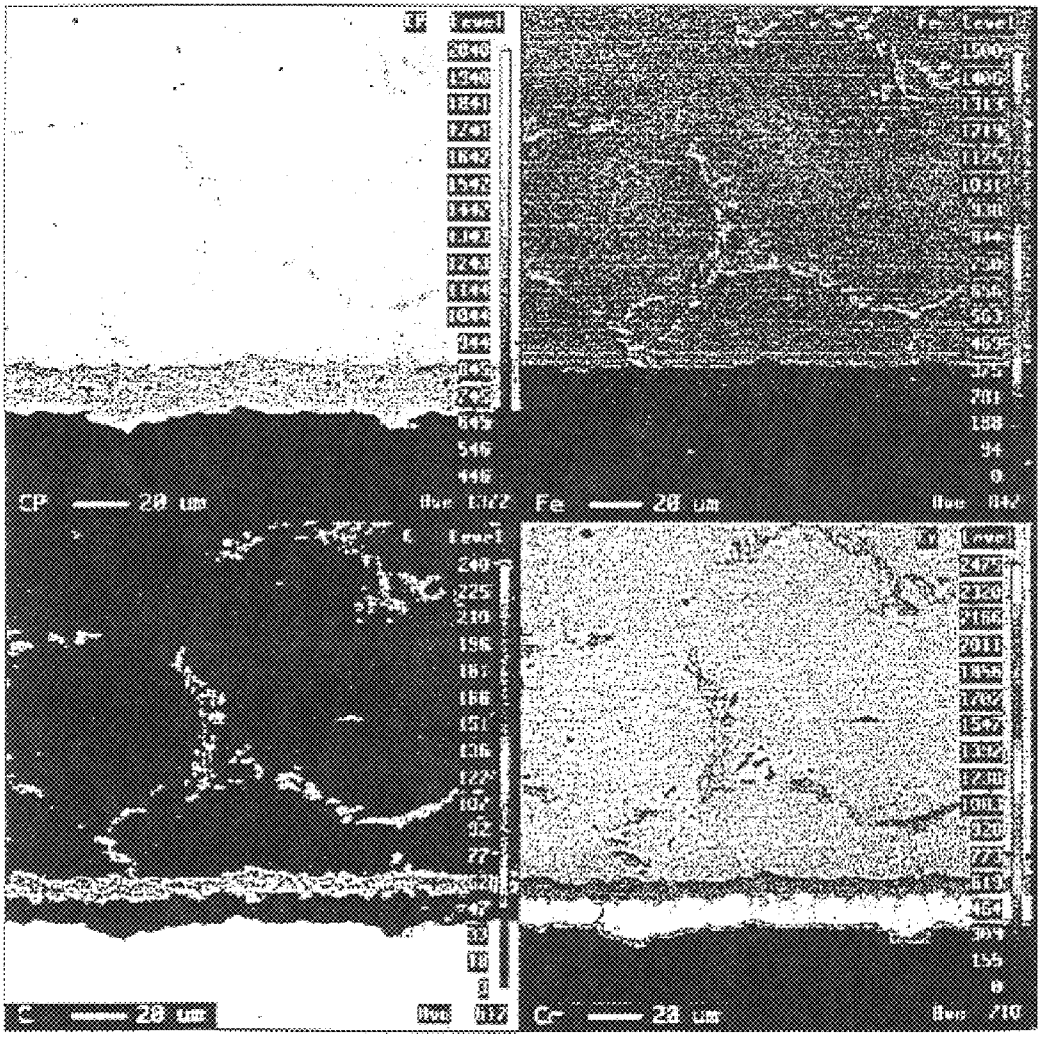
FIGS. 1A, 1B, 1C and 1D illustrate the metallographic profile of a chromized article produced in accordance with Example 1.

The following examples illustrate the invention.

EXAMPLE 1

A Manaurite XM® refractory steel with the following composition was treated by pack cementation:

TABLE 2

| | C | Mn | Si | Ni | Cr | Fe | additions |
|---|---|---|---|---|---|---|---|
| Manaurite XM ® | 0.35–0.60 | 1–1.5 | 1.2 | 33–38 | 23–28 | compl. | Nb, Ti, Zr |

A chromized article was obtained which had the characteristics shown more particularly in the accompanying metllographic profile (see FIGS. 1A, 1B, 1C and 1D), comprising a photograph of a transverse section of a coated article (FIG. 1A), also distribution diagrams (using Castaing microprobe analysis) of the constituent elements X of the substrate and the deposit (iron, carbon and chromium, in FIGS. 1B, 1C and 1D respectively): the variation in the intensity of the signal enabled the composition of the different zones to be compared. Thus zones which appear white are very rich in the element under consideration.

As an example, for the carbon image FIG. 1C), a grey barrier of homogeneous thickness is observed which corresponds to the carbon-rich inner diffusion barrier of the coating.

In the chromium image (FIG. 1D), the outer white coloured zone of the coating corresponds to an amount of 96% by weight of chromium.

A quantitative analysis of the various elements was carried out on the chromized article for the matrix (or substrate) itself, for the edge thereof, and for the chromium deposit at its inner and outer edges. These different zones are easily visible from top to bottom in the Figures, in particular FIG. 1D, where the chromium appears white. The quantities of the various elements are shown in the following table:

TABLE 3

| Element | Si (%) | Ni (%) | Cr (%) | Fe (%) | C (%) | Nb (%) | Mn (%) |
|---|---|---|---|---|---|---|---|
| Matrix | 1.6 | 33.0 | 22.9 | 40.0 | 0.6 | 0.2 | 1.0 |
| Matrix edge | 1.6 | 33.6 | 23.8 | 39.4 | 0.8 | 0.1 | 1.0 |
| Deposit | | | | | | | |
| Inner | — | 3.8 | 84.2 | 5.0 | 5.5 | — | — |
| Outer | 0.3 | 1.3 | 95.6 | 3.2 | 0.8 | — | — |

EXAMPLE 2 (comparative)

Chromium was deposited electrolytically. This was effected by immersing a sample of Manaurite XM® refractory steel as the cathode in a chromate bath and reducing the chromate ions to metallic chromium at the cathode. A chromed steel was obtained which was termed electrolytically chromed Manaurite XM®.

EXAMPLE 3

Tests were carried out with a hydrocarbon and water feed under steam cracking conditions at 800° C. The coking rate was monitored by thermogravimetric analysis. Samples taken from the whole surface were placed in a perfectly homogeneous steam cracking reactor and suspended on the beam of the thermobalance. A number of hours into the experiment, the rate stabilised at an asymptotic value characteristic of the coking reactivity of the deposit. Air decoking was then carried out to follow the behaviour during coking-decoking-coking etc. cycles.

A Manaurite XM® refractory steel chromized as described in Example 1 was used, also, for comparison, a sample of Manautite XM® itself, also a sample of the same type of steel coated (by CVD) with a layer of titanium carbide and a layer of silicon carbide, a sample of steel of the same type coated with a titanium carbide layer (by CVD), and a sample of electrlytically chromed Manaurite XM®.

The test was carried out at 800° C., with a feed of hexane and water for a conversion of about 30%. The results shown in Table 4 below were obtained.

TABLE 4

| | Asymptotic coking rate ($g/m^2h$) | |
|---|---|---|
| | First coking | Second coking |
| Manaurite XM ® | 1.00 | 1.05 |
| Electrolytically chromed Manaurite XM ® | 0.60 | 0.65 |
| Manaurite XM ® /TiC | 0.46 | 0.47 |
| Manaurite XM ® /TiC/SiC | 0.19 | 0.50 |
| Chromized Manaurite XM ® | 0.20 | 0.20 |

These results show that the use of the chrornized Manaurite XM® of Example 1 of the invention led, after the first coking, to a much lower coking rate than that observed with Manaurite XM® before chromizing (5 times lower) or that observed with electrolytic Manaurite XM® or that with Manaurite XM® coated with a titanium carbide layer. The chromized Manaurite XM® of Example 1 also produced good results after the second coking. A steel coated with titanium carbide and silicon carbide produced poor results from the second coking.

EXAMPLE 4

Thermal cycling resistance tests were carried out to simulate thermal shocks to which industrial steam cracking tubes may be subjected. These tests were carried out in an air injected muffle still. The samples underwent 15 heating and cooling thermal cycles, from ambient temperature to 1000° C. (and vice versa), at a heating (or cooling) rate of 500° C. per hour. For the first 15 cycles, the articles were examined after each cycle.

Manaurite XM® refractory steel chromized as in Example 1 was evaluated using the above protocol. After 145 cycles (corresponding to a cumulative thermal cycle in an industrial unit for a service life of an estimated 10 years), the steel had not degraded. For the first 15 cycles, the articles were examined after each cycle. Metallographical examination confirmed the integrity of the coating.

By way of comparison, thermal cycling resistance tests were carried out under the same conditions using a coating of titanium carbide alone: after 10 cycles, the layer was observed to have completely disappeared. Further, with a coating of titanium carbide and silicon carbide, the silicon carbide layer was observed to have disappeared after 5 cycles.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a process comprising conducting a refining or petrochemical process in an apparatus under conditions resulting in the formation of coke deposited onto at least one surface of a article inside said apparatus, the improvement wherein said artical comprises a refractory steel substrate comprising at least 0.2% by weight of carbon; a carbon-rich diffusion barrier; and an outer layer containing 90–99% by weight of chromium, said article having been coated by a cementation method, and wherein said coke is deposited on said outer layer.

2. A process according to claim 1, comprising passing hydrocarbon into tube bundles of a hydrocarbon pyrolysis reactor in the presence or absence of steam and at pyrolysis temperatures, said article comprising said tube bundles.

3. A process according to claim 1, comprising conducting a petrochemical treatment in a fixed bed reactor, and said article comprises rings and/or baffles.

4. A process according to claim 1, comprising conducting a visbreaking process, and said article comprises tube bundles employed in said visbreaking process.

5. A process according to claim 1, comprising conducting a steam reforming process.

6. A process according to claim 1, comprising conducting a steam cracking process.

7. A process according to claim 1, wherein said article has been coated by pack cementation or by gas phase cementation.

8. A process according to claim 1, wherein said article has been coated by pack cementation.

9. A process according to claim 8, wherein said pack cementation comprises heating the refractory steel, in the presence of a source of chromium to be deposited, to a sufficient temperature to simultaneously diffuse said chromium onto the surface of said refractory steel and to form said carbon rich diffusion barrier.

10. A process according to claim 9, wherein said temperature is 900–1200° C.

11. A process according to claim 1, wherein said refractory steel substrate comprises 0.2–0.8% by weight of carbon.

12. A process according to claim 1, wherein said refractory steel substrate comprises 0.2–0.75% by weight of carbon.

13. A process according to claim 11, wherein said refractory steel substrate comprises 0.2–0.75% by weight carbon, 1–2% by weight manganese, 1–2.5% by weight silicon, 18–48% by weight nickel, and 19–37% by weight chromium, and further optionally contains niobium, tungsten, titanium, zirconium or mixtures thereof.

* * * * *

UNITED STATES PATENT AND TRADEMARK OFFICE

CERTIFICATE OF CORRECTION

PATENT NO. : 6,348,145 B1
DATED : February 19, 2002
INVENTOR(S) : Ropital et al.

It is certified that error appears in the above-identified patent and that said Letters Patent is hereby corrected as shown below:

Title page,
Item [57], replace ABSTRACT with new ABSTRACT:

-- Coated steel articles comprising:

- a refractory steel substrate comprising at least 0.2% by weight of carbon;
- a carbon-rich diffusion barrier; and
- an outer layer containing 90% to 99% by weight of chromium, coated by a cementation method, exhibit anti-coking properties when employed in processes wherein coking occurs. Preferably, the coated steel articles are used as tubes in reactors or stills for various refining or petrochemical processes. --

Signed and Sealed this

Third Day of December, 2002

JAMES E. ROGAN
*Director of the United States Patent and Trademark Office*